US006934989B2

(12) United States Patent
Ledvina et al.

(10) Patent No.: US 6,934,989 B2
(45) Date of Patent: Aug. 30, 2005

(54) INFLATABLE ARTICLE

(75) Inventors: David M. Ledvina, Luxembourg, WI (US); David J. Pisani, Green Bay, WI (US); Melanie Pilling, Green Bay, WI (US)

(73) Assignee: Little Rapids Corporation, Green Bay, WI (US)

( * ) Notice: Subject to any disclaimer, the term of this patent is extended or adjusted under 35 U.S.C. 154(b) by 0 days.

(21) Appl. No.: 10/678,494

(22) Filed: Oct. 3, 2003

(65) Prior Publication Data

US 2004/0064892 A1 Apr. 8, 2004

Related U.S. Application Data

(60) Provisional application No. 60/416,279, filed on Oct. 3, 2002.

(51) Int. Cl.[7] ..... A47G 9/10; F16K 11/00

(52) U.S. Cl. ..... 5/644; 5/708; 137/238; 137/846

(58) Field of Search ..... 5/644, 708, 932; 137/223, 846; 410/119, 125

(56) References Cited

U.S. PATENT DOCUMENTS

| | | | | |
|---|---|---|---|---|
| 1,624,102 | A | | 4/1927 | Kennedy |
| 2,864,201 | A | | 12/1958 | Leise |
| 3,009,498 | A | | 11/1961 | Fohr |
| 3,192,540 | A | | 7/1965 | Swank |
| 3,283,343 | A | | 11/1966 | Worcester |
| 3,332,415 | A | | 7/1967 | King |
| 3,638,253 | A | | 2/1972 | Stumpf |
| 4,465,188 | A | | 8/1984 | Soroka et al. |
| 4,674,532 | A | | 6/1987 | Koyanagi |
| 4,842,007 | A | | 6/1989 | Kurtz |
| 4,877,334 | A | | 10/1989 | Cope |
| 4,917,646 | A | | 4/1990 | Kieves |
| 4,983,138 | A | | 1/1991 | McGrath |
| 5,178,281 | A | | 1/1993 | Enzu |
| 5,188,558 | A | | 2/1993 | Barton et al. |
| 5,209,264 | A | | 5/1993 | Koyanagi |
| 5,248,275 | A | | 9/1993 | McGrath et al. |
| 5,254,074 | A | | 10/1993 | Landers et al. |
| 5,308,163 | A | * | 5/1994 | Abe ..... 383/44 |
| 5,348,157 | A | | 9/1994 | Pozzo |
| 5,524,308 | A | | 6/1996 | Hwang et al. |
| 5,564,143 | A | | 10/1996 | Pekar et al. |
| 5,632,055 | A | * | 5/1997 | Graf ..... 5/706 |
| 5,830,780 | A | | 11/1998 | Dennison et al. |
| 5,860,441 | A | | 1/1999 | Garcia |
| 5,878,768 | A | | 3/1999 | Tarazaga Carrasco |
| 5,934,310 | A | | 8/1999 | Littlehorn |
| 6,019,122 | A | * | 2/2000 | Chen ..... 137/223 |
| 6,170,513 | B1 | * | 1/2001 | Lo ..... 137/223 |
| 6,175,978 | B1 | | 1/2001 | Nizzi et al. |
| 6,418,579 | B2 | * | 7/2002 | Perez et al. ..... 5/713 |

* cited by examiner

*Primary Examiner*—Michael Trettel
(74) *Attorney, Agent, or Firm*—Nicholas A. Kees; Godfrey & Kahn, S.C.

(57) ABSTRACT

An inflatable, disposable pillow which can be conveniently carried and stowed by users in a deflated state, and used as a comfortable, clean pillow in an inflated state. The inflatable pillow includes a single folded sheet or two sheets sealed together to form side walls. A flat self-sealing valve comprising two sheets of flexible material is placed between the sidewalls. The sheet or sheets may be comprised of multiple plies, with an outermost ply being an absorbent material. Alternatively, an absorbent cover may be attached to the outermost surface of at least one side of the pillow.

25 Claims, 4 Drawing Sheets

INFLATABLE ARTICLE

CROSS-REFERENCE TO RELATED APPLICATIONS

This application claims the benefit of U.S. Provisional Application Ser. No. 60/416,279, filed Oct. 3, 2002.

BACKGROUND OF THE INVENTION

This invention relates generally to improvements in the art of inflatable articles, and more particularly to improvements in the construction of inflatable pillows of the type embodying valved access openings.

Emergency medical personnel often need to support a part of a patient's body during treatment and transport. Pillows are the item of choice, however, pillows are bulky and quickly take up the limited storage space within an emergency vehicle such as an ambulance or helicopter. Further, because of strict sanitation requirements, any pillow used for any reason must be either sterilized or disposed of before reuse. This means that a stock of pillows must be rotated or supplied to the emergency vehicle. Because of the limited space in the vehicle, the restocking of pillows must occur frequently, or the pillows must take up little space on the vehicle prior to use.

A storage problem for pillows is also seen in the travel industry. Whereas comfort items such as pillows, blankets and related items used to be plentiful and widely available for all on board, presently such items are commonly in scarce supply, especially in coach or economy class. Storage space previously allocated to items such as pillows and blankets has been usurped to hold baggage and other items carried on by passengers. Further, passengers may have concerns about the cleanliness of airline pillows.

Inflatable pillows solve the problem of storing bulky pillows. Unfortunately, such pillows are expensive, not easy or quick to fill and may not come with attached covers. For example, U.S. Pat. No. 6,175,978 to Nizzi et al. discloses an inflatable pillow. However, the valve of the Nizzi pillow requires one to blow on a tube and then close the tube to prevent air leakage. This design presents several disadvantages. First, blowing on the tube by mouth is too unsanitary for some medical uses. Second, having to quickly close the inflation tube before the desired amount of air leaks out is overly time consuming in situations when seconds count. Third, the valve could be uncomfortable if one were to lie against it.

Nizzi also discloses a cover for an inflatable pillow. The cover is a sheet attached midway along one pillow seam, and then taped together at the opposite pillow seam. Thus, the cover loosely wraps around the pillow. This cover would not work well for persons that are restless because it could come off too easily.

There is therefore a need for a pillow which is suitable for use by emergency medical personnel, which pillow may be conveniently carried on-board an ambulance and take up minimal space when not in use. Similarly, there is a need in hospitals or shelters, or analogous locations during emergencies such as after a natural disaster, for a disposable pillow that stores compactly prior to use. Of course, such pillows may be used in spas, on the beach and on airplanes or the like. The pillow should be comfortable to use and should be pleasant to contact with the skin on the face and head. Such a pillow should provide a clean interface to the user. The pillow should be inexpensive so that, if desired, it may be disposed of after even only one use. Further, the pillow should be easy to use in an emergency situation.

SUMMARY OF THE INVENTION

Disclosed is an inflatable, disposable pillow which is suitable for use by emergency medical personnel, spas, and passengers on airplanes and other vehicles. The inflatable pillow of the invention is comfortable, clean and easy to use. The inflatable pillow is inexpensive so that it may be disposed of, even after only one use. In a deflated state, the inflatable pillow of the invention may be conveniently carried or stowed in a minimal space.

In a first aspect of the invention, the pillow is basically constructed from two sheets of material such as plastic. A flat, flexible valve is placed between the sheets. The valve has an exterior opening and an interior opening, the width of the exterior opening gradually decreasing toward an interior volume of the disposable pillow. The sheets are registered and the valve positioned so the exterior opening coincides with an edge of the pillow. The two sheets are sealed along an outside perimeter of the pillow to create a marginal edge. There is a local break in the seal at the exterior opening of the valve. The valve may be inflated and remains closed because of its self-sealing design.

In another aspect of the invention, the two sheets are replaced by a single sheet that is folded over, thereby negating the need to seal the folded edge.

In yet another aspect of the invention, a method for manufacturing the pillow is provided.

In a further aspect of the invention, check valve is designed so that additional accessories are not needed to deflate and/or inflate the inflatable article. The valve has a most preferred overall width of about 3.5 inches, a most preferred length of about 5 inches and a most preferred opening at one end of about 1 inch. These dimensions work well for inflation by mouth, and deflation by inserting a finger into the valve.

Various other features, objects, and advantages of the invention will be made apparent to those skilled in the art from the following detailed description including illustrative examples setting forth how to make and use the invention.

BRIEF DESCRIPTION OF DRAWINGS

A clear understanding of the several features constituting the present invention and of the mode of constructing and of utilizing a preferred embodiment of the present invention may be had by referring to the drawings accompanying and forming a part of this specification, wherein like reference characters designate the same or similar parts in the various views.

DETAILED DESCRIPTION OF THE PREFFERED EMBODIMENT

Figure 1:
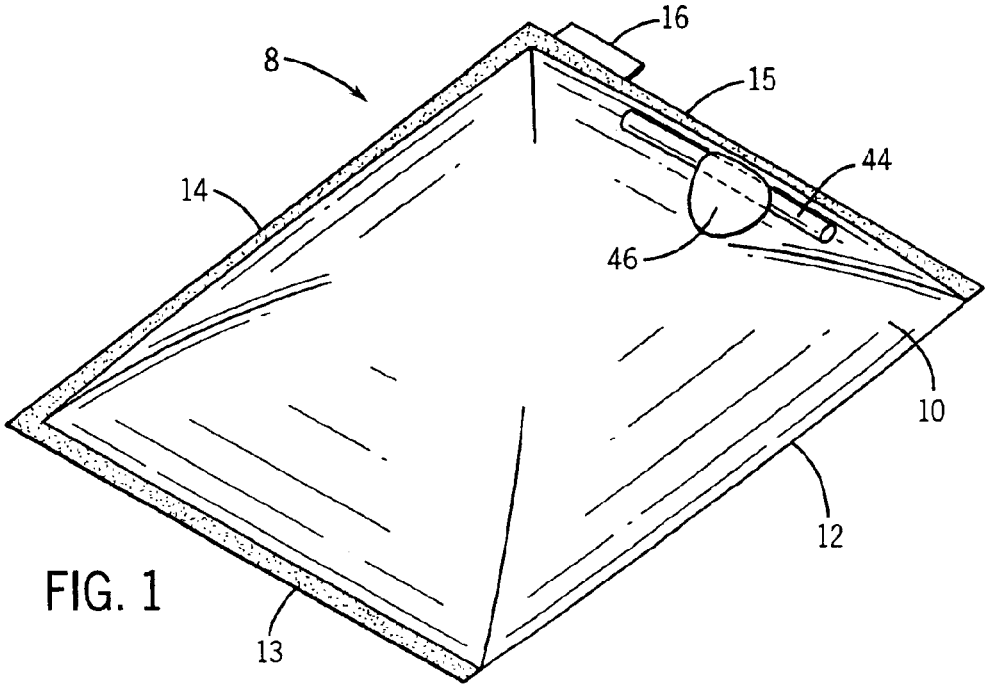
FIG. 1 is a top perspective view of an inflatable article according to the most preferred embodiment of the present invention, the inflatable article shown in an inflated state.

While the improved inflatable article has been specifically shown and described herein as being embodied in a rectangular bag-like article formed of heat-sealable sheet material such as low density polyethylene, with the seals formed by application of heat and pressure, it is not desired or intended to thereby unnecessarily limit the invention by reason of such restricted disclosure. It is furthermore contemplated that certain descriptive terms used herein shall be given the broadest possible interpretation consistent with the disclosure.

Referring to the drawings, and particularly FIGS. 1–9 thereof, the improved inflatable article 8 shown therein is fabricated of flexible heat-sealable sheet material. In the particular embodiment shown, the article 8 includes side walls 10, 11 being formed by folding a single sheet along a medial line to form a first marginal edge 12. Second, third and fourth marginal edges 13, 14 and 15, respectively, are joined, preferably by heat sealing, such that a closed compartment is formed with the exception that the fourth marginal edge 15 is locally interrupted so that a flexible valve 16 may provide restricted access to the interior of the inflatable article 8.

Figure 2:
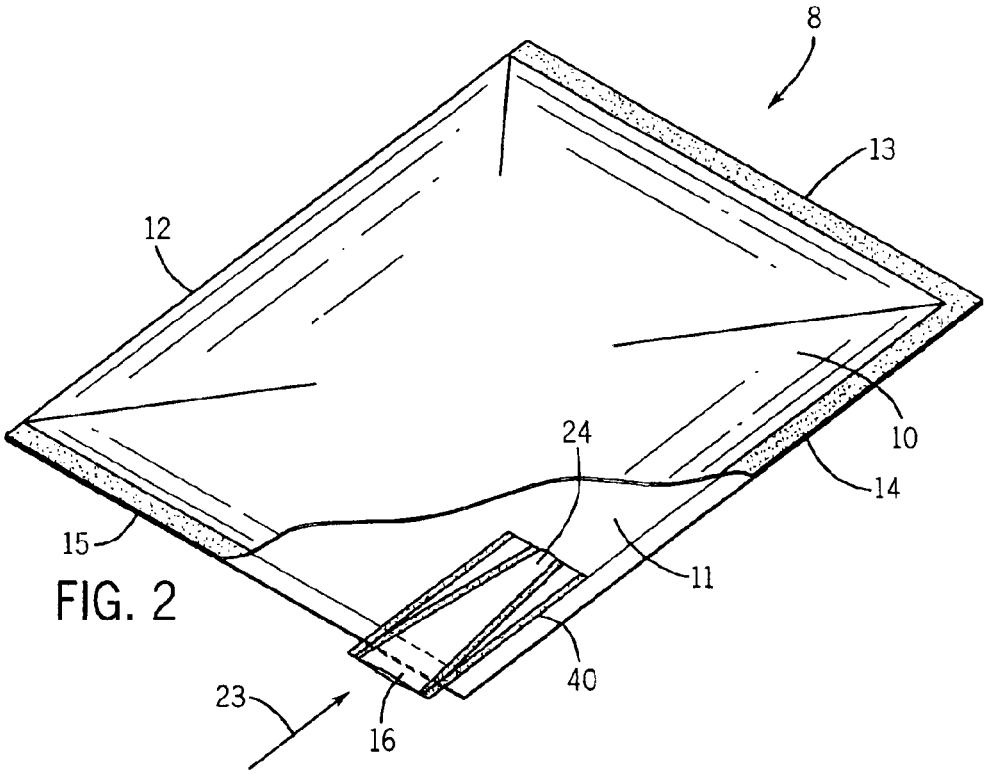
FIG. 2 is a top perspective view of the inflatable article of FIG. 1, shown in a deflated state and with the outer covering shown partially cutaway to illustrate the valve.
Figure 3:
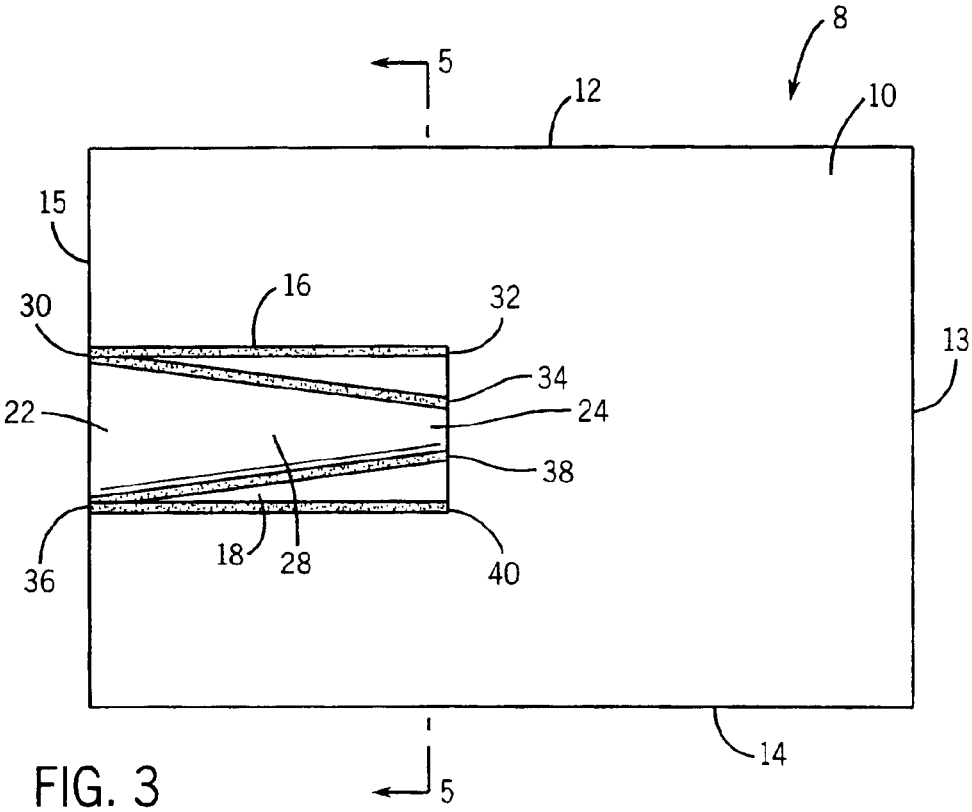
FIG. 3 is a side view of an inflatable article according to another preferred embodiment of the present invention.
Figure 5:
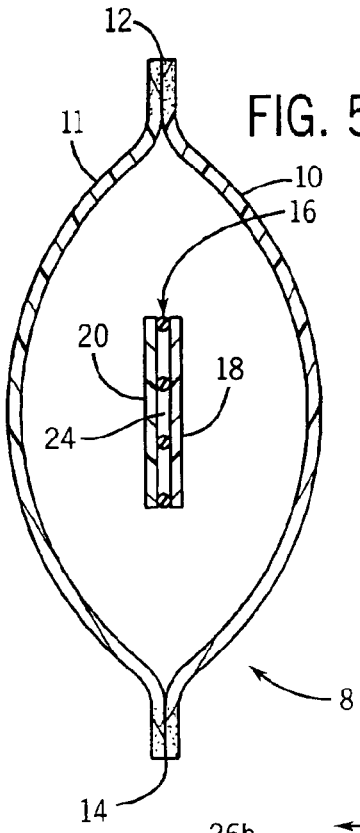
FIG. 5 is a transverse section through the inflatable article of FIG. 3 taken along the line 5—5 and showing the inflatable article in an inflated condition.

As best shown by comparing FIGS. 3 and 5, flexible valve 16 passes through marginal edge 15 to lie between side walls 10, 11. In a preferred embodiment, flexible valve 16 is preferably made up of two valve side portions 18, 20 of flexible material (which may be the same material as that forming the side walls 10, 11), bonded together by seals between points 30 and 32, points 30 and 34, points 36 and 38, and points 36 and 40, as best shown in FIG. 2. The valve 16 may be constructed from tube stock, negating the need to actually create a seal between points 30 and 32, and points 36 and 40.

Flexible valve 16 is fixedly supported in the inflatable article by fastening at a first valve end such that side wall 10 is sealed to valve side portion 18 and side wall 11 is sealed to valve side portion 20. A first duct opening 22 is thusly formed between points 30 and 36. A passageway 28 formed between the seals from points 30 to 34 and points 36 to 38 extends to a second duct opening 24 located between points 34 and 38. Valve 16 may be mounted flush to the marginal edge 15 as seen in FIG. 3, or valve 16 may protrude from marginal edge 15 as seen in the most preferred embodiment of FIG. 2. There may be instances when locating or manipulating valve 16 is made more convenient for the user when it protrudes from the marginal edge.

Figure 4:
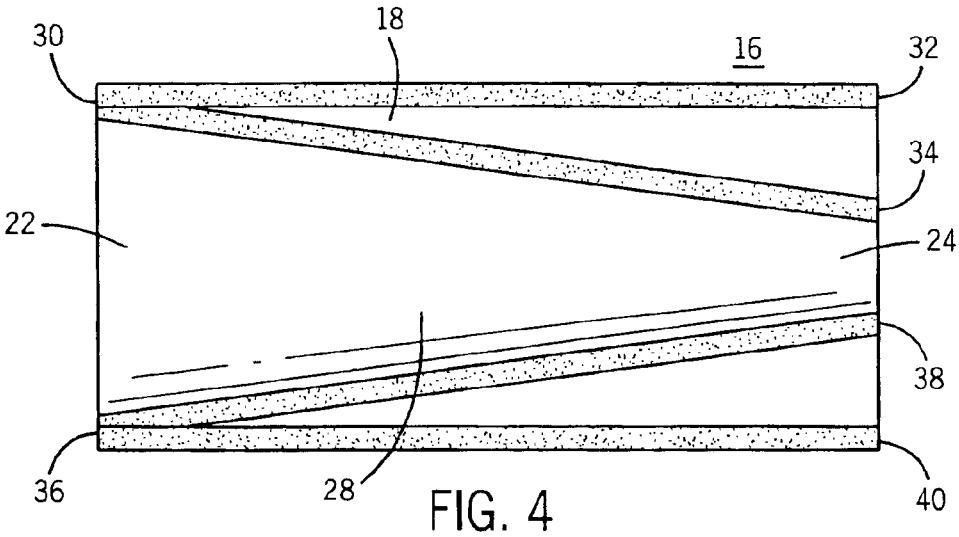
FIG. 4 is a side view of a flexible valve according to the present invention, isolated from the inflatable article shown in FIGS. 1 and 3.

Referring to FIG. 4, in a preferred embodiment, flexible valve 16 is formed such that the width or cross-sectional area of the first duct opening 22 formed between points 30 and 36 is approximately equal to the width or cross-sectional area between points 32 and 40. In contrast, the width or cross-sectional area of the second duct opening 24 formed between points 34 and 38 is smaller than the width or cross-sectional area of the first duct opening 22 between points 30 and 36. Furthermore, the width or cross-sectional area of the passage 28 formed between the seals from points 30 to 34 and points 36 to 38 decreases gradually from the first duct opening 22 to the second duct opening 24 in a preferred embodiment. Moreover, the seal lines between points 30 and 32, points 30 and 34, points 36 and 38, and points 36 and 40, respectively, while shown as straight lines, may also be curved.

The portion of flexible valve 16 within the inflatable article 8 forms a reliable check valve. Juxtaposed inner surfaces of the valve side portions 18, 20 operate as a check valve due to the mutual adherence of said surfaces when flattened and pressed one against the other under the action of the pressure of a gas or liquid contained within the inflatable article. Since valve side portions 18, 20 are in physical engagement or contact with each other, a spontaneous escape of the contents of the inflatable article 8 through valve 16 is practically impossible. The pressure prevailing in the inflatable article tends to maintain the valve side portions 18, 20 in physical engagement and opposing side portions 18, 20 are unable to move apart. In addition, the seals formed between points 30 to 32 and 36 to 40 provide structural strength and stability to flexible valve 16 and preclude valve 16 from folding over upon itself under the action of pressure prevailing in the inflatable article 8.

In some applications a larger amount of pressure may be applied to the pillow, such as when the pillow is sat upon, or when an especially heavy limb or object is placed thereon. Such high pressure may cause valve 16 to invert through duct opening 22, thereby deflating the article 8. To prevent such unintended deflation, the bond either between points 30 and 32 or points 36 and 40 may coincide with any seal placed along a marginal edge of article 8, such as a first marginal edge 12 seal or second marginal edge 14 seal, respectively. One example of the resulting article 8 is shown in FIGS. 1 and 2. This embodiment is most preferred because it may be used in applications that require a higher factor of safety.

Referring to FIGS. 1 and 2, to fill an inflatable article according to the present invention, a tube may be inserted in the flexible valve 16 at first duct opening 22 and the filling gas or fluid may be made to flow through this tube into the inflatable article, see reference arrow 23. During the filling operation, the side portions 18, 20 of flexible valve 16 will stand apart due to the presence of the tube to allow introduction of the gas or fluid. However, upon withdrawal of the tube, side portions 18, 20 will engage each other along a substantial portion and therefore prevent escape of the contents introduced into the compartment of the inflatable article. In an alternative method of inflation, sufficient pressure is applied to the first duct opening 22 such that the pressure applied is greater than the pressure of the article contents causing a flow of gas or fluid through valve 16 until the pressure inside the article is equal to or greater than the pressure applied to first duct opening 22.

Deflation of the article may be achieved by inserting, for example, the same tube used for inflation such that side portions 18, 20 are parted and the article's contents are allowed to flow outward until the pressure within the article has equalized with the surrounding environment. The article may then be reused if desired. Fast deflation may be achieved by instead puncturing the inflatable article.

For convenience, the tube may be a straw 44, and attached to the exterior surface of article 8 for ease of access, see FIG. 1. The attachment may be achieved with a tape or sticker 46 or the like, that preferably sticks only to the article or surface, and not the straw 44. This way, a user may simply slide straw 44 away from the sticker 46. In another embodiment, the tape or sticker 46 is easily removable without tearing article 8.

In an alternate embodiment, an inflatable article according to the present invention may be formed by bonding two separate sheets along their entire periphery without the step of folding a single sheet at a medial line. Thusly, marginal edge 12 would be sealed and not folded over in nature. Likewise, flexible valve 16 may be constituted by a single sheet of suitable material folded over itself and bonded together at the two aligned or registered edges of the sheet or, alternatively, by two separate sheets of flexible material joined along opposing edges.

When creating the bonds between side walls 10 and valve side portions 18 and side wall 11 and valve side portion 20, respectively, it may be necessary to place an intermediary sheet, for instance, a sheet of cellulose acetate or metallic foil, between the internal walls of the flexible valve 16 in order to prevent these portions 18, 20 from being bonded together during the sealing process. Examples of such sealing technology are well known in the art, as exemplified by U.S. Pat. No. 3,332,415 to Ericson. Use of such an intermediary sheet or spacer may be dispensed with if the portions of the valve side portions 18, 20 are coated with a suitable material forming a separable bond by precluding the formation of a permanent bond. Examples of such a alternate sealing approaches are well known in the art as illustrated by U.S. Pat. No. 4,917,646 to Kieves in which a heat resistant nitrocellulose ink is applied between side portions 18, 20 to preclude bond formation.

Flexible valve 16, as well as side walls 10, 11, may be made from a wide variety of materials including, for example, polyethylene, Mylar, nylon and polyvinyl chloride. This list is meant to be illustrative and further equivalent materials based on flexibility and resiliency are certainly contemplated as being within the scope of the present invention. In a preferred embodiment, low density polyethylene forms both the side walls 10, 11 and valve 16. The polyethylene may range in thickness from about 0.001 inches to 0.050 inches with 0.003 inches being the preferred thickness.

Materials forming side walls 10, 11 and flexible valve 16 may be joined in the present invention by any conventionally available means which would not unduly restrict the operation of the inflatable article including, most particularly, the operation of the flexible valve 16. It is preferred that material layers be bonded by a heat sealing technique such as thermal impulse heating or hot bar heating. Among presently available bonding techniques, thermal impulse heating has been found to be particularly desirable. The temperatures, pressures and other perimeters used in bonding the respective members will depend upon the material of the materials, their thicknesses, the length and width of the article side walls 10, 11 and valve 16, and the desired flexible valve 16 crack resistance and reflux sensitivity.

Figure 7:
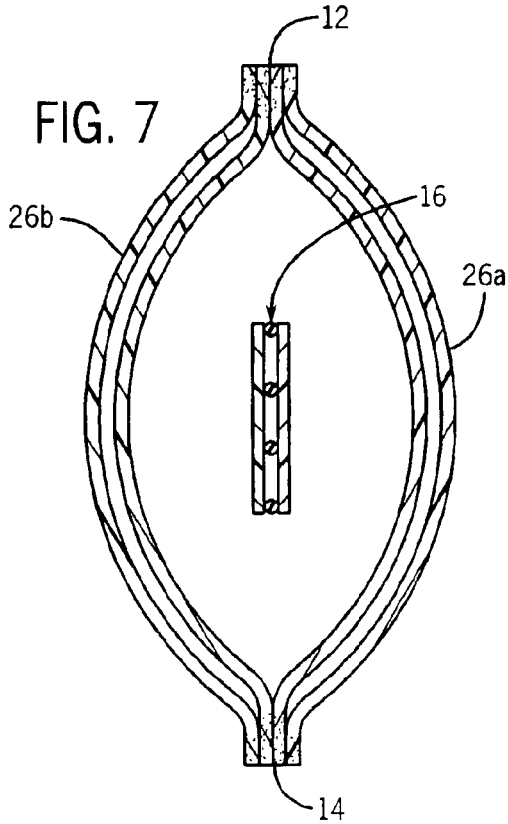
FIG. 7 is a transverse section through the inflatable article shown in FIG. 6 along the line 7—7.
Figure 6:
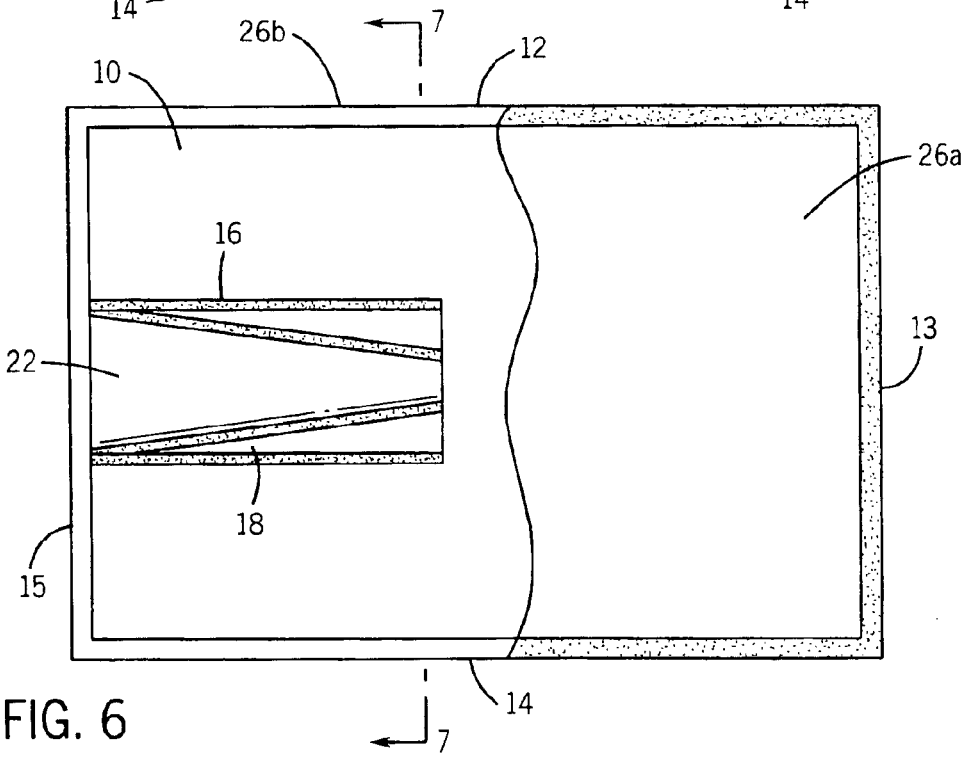
FIG. 6 is a side view of an inflatable article incorporating an embodiment of the present invention in which an outer covering is provided which substantially envelops the inflatable article and the outer covering is shown partially cutaway to illustrate the enveloped inflatable article.

A further embodiment of the present invention is shown in FIGS. 6–7, wherein an outer covering 26 is provided which substantially envelops the inflatable article 8 described above. In one embodiment, the outer covering 26 is provided with a first flexible wall member 26*a* and a second flexible wall member 26*b* each having marginal edges substantially co-extensive with and coupled to the marginal edges of at least one of the marginal edges 12, 13, and 14 of the side walls 10, 11.

Alternatively, outer covering 26 may, in similar fashion to the inflatable article, be formed from a single sheet folded at a medial line and thusly partially wrapped around the inflatable article. In a preferred embodiment, outer covering 26 completely envelops the inflatable article described above and is joined to side walls 10, 11 of the inflatable article along, specifically, marginal edges 12, 13 and 14. The coupling of the first flexible wall member 26*a* and the second flexible wall member 26*b*, as described above, define a pocket which is closed at three sides and open at a fourth. In addition, one of the flexible wall members (e.g., flexible wall member 26*a*) may be coupled to a marginal edge of one of the side walls 10, 11 along edge 15 such that the inflatable article may not be easily removed from the pocket formed by the outer covering 26.

Outer covering 26 may be formed of a soft material and or an absorbent material such as a loosely woven cotton fabric, nonwoven, paper or other equivalent material presenting at least a soft pliant surface on which a human may comfortably rest a body part such as an arm, foot or head. Coupling of the outer covering 26 to the side walls 10, 11 may be accomplished by any suitable means known in the art including heat sealing, as described above, or adhesive glues and the like. The outer covering may be attached to one or both surfaces of the inflatable article.

Figure 8:
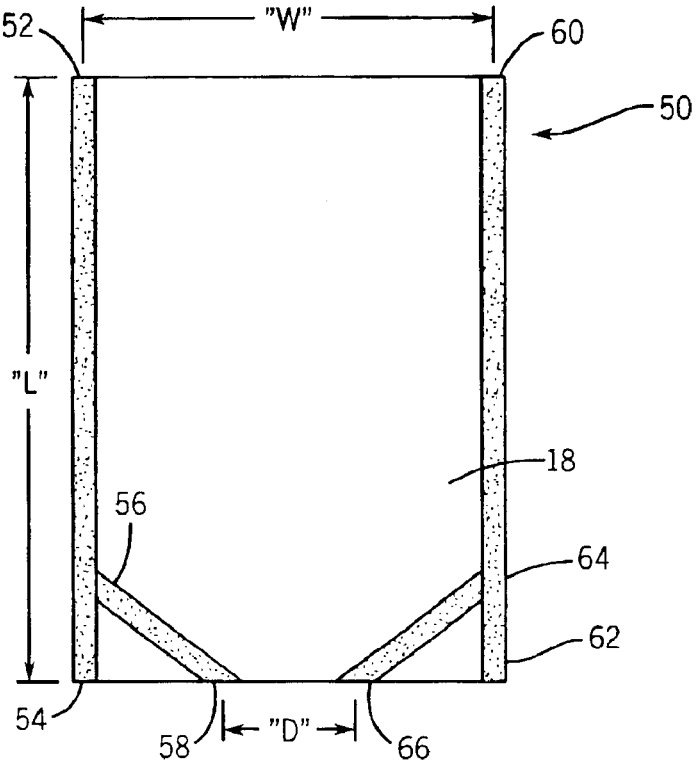
FIG. 8 is a plan view of another embodiment of the valve of the present invention.
Figure 9:
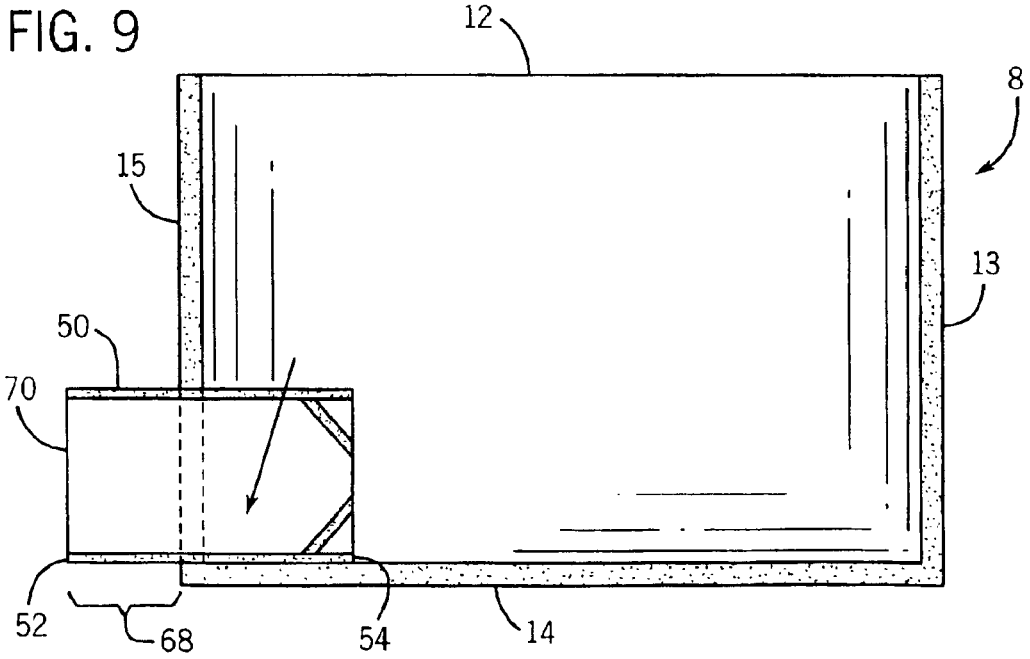
FIG. 9 is a plan view of an inflatable article of the present invention, with the valve of FIG. 8.

Yet another embodiment of the present invention is shown in FIGS. 8 and 9. FIG. 8 in particular shows a valve 50 that is similar to valve 16 with respect to the materials from which valve 50 is made, and with respect to its flat profile. However, the valve 50 is configured so that a tube or straw is not necessary for inflation or deflation. Similar to valve 16, flexible valve 50 is made from two valve side portions 18, 20 of flexible material (which may be the same material as that forming the side walls 10, 11), bonded together by seals between points 52 and 54, points 56 and 58, points 60 and 62, and points 64 and 66, as best shown in FIG. 8. Like valve 16, valve 50 may be constructed from tube stock so that sides are pre-formed, negating the need to create a seal between points 52 and 54, and points 60 and 62.

Referring to FIG. 9, valve 50 is preferably positioned on the inflatable article so that it extends roughly about 2 inches (5.1 cm) beyond the marginal edge 15 of inflatable article 8. Further valve 50 may be positioned so that an edge between points 52 and 54 coincides with marginal edge 14 as shown, or may be positioned similar to valve 16 in the embodiment shown in FIG. 4.

In operation, a user gathers the extension 68 so that it is pursed together, and blows air into the inflatable article 8. The mutual cohesion occurring between the plastic valve side portions 18, 20 help maintain the valve seal. To open the valve 50 to fully or partially deflate the inflatable article 8, one inserts an elongated article into open end 70 to separate the valve side portions 18, 20. A finger is a very convenient elongated article to use toward this end, but tubes, pencils, sticks or the like may also be used.

Referring again to FIG. 8, in a most preferred embodiment of valve 50, the following dimensions are desirable for optimum performance. The width "W" of valve 50 is preferably about 3.5 inches (8.9 cm) or greater. This provides enough material between points 52 and 60 so that one can purse the valve end together and blow up the inflatable article 8 by mouth. The width W may vary from this preferred dimension; however, if this particular dimension becomes too small, it is difficult to purse the material, and if the particular dimension is too large, it becomes overly cumbersome to blow into the valve.

The length "L" of valve 50 is preferably about 4.5 inches (11.4 cm) and most preferably about 5 inches (12.7 cm). If length L is too long, it becomes difficult to insert a finger into valve 50 to selectively deflate the inflatable article 8. If length L is too short, it will not seal adequately and the pillow could inadvertently deflate. This length L also takes into account that valve 50 preferably extends beyond a marginal edge of the inflatable article 8 by about 2 inches (5.1 cm).

The distance "D" between points 58 and 66 is preferably about 1 inch (2.54 cm). If distance D is too small, then it becomes difficult for an average-size finger to deflate the inflatable article 8. If distance D is too large, a seal may not reliably form and the inflatable article 8 could inadvertently deflate.

While particular embodiments of the invention have been shown and described, it will be obvious to those skilled in the art that various changes and modifications may be made therein without departing from the spirit and scope of the invention and, therefore, it is intended in subsequent claims to cover all such changes and modifications which fall within the true spirit and scope of the invention. For example, the pillow may be used in spas, on the beach, on planes, trains and buses or in many other industries where a clean and easy to use pillow is desired. In addition, the inflatable article could be made into various shapes, including novelty shapes.

We claim:

1. A disposable pillow comprising:

a single sheet folded along a medial line, to form two side walls; separated by a marginal edge;

a second, third and fourth marginal edge formed by sealing the two side walls around a perimeter of the folded single sheet to create a seal;

a check valve located between the two side walls in one of the second, third or fourth marginal edges, so as to locally break the marginal edge seal where the check valve is located;

wherein the check valve comprises;

a first side portion;

a second side portion registered with the first side portion and sealed along two opposite edges to form a first side seal and a second side seal and creating a top opening and a bottom opening;

a first valve seal extending from the first side seal and terminating at the bottom opening; and a second valve seal extending from the second side seal and terminating at the bottom opening;

wherein the first valve seal and second valve seal converge at the bottom opening.

2. The disposable pillow of claim 1 further including a tube removably attached to an exterior surface of one of the two side walls.

3. The disposable pillow of claim 1 wherein the single sheet is comprised of a multiple ply material, and the outermost ply is an absorbent material.

4. The disposable pillow of claim 3 wherein the absorbent material is a nonwoven fabric.

5. The disposable pillow of claim 3 wherein the absorbent material is paper.

6. The disposable pillow of claim 1 further including an outer covering coupled to at lease one of the two side walls.

7. The disposable pillow of claim 1 wherein the medial line is cut to form the single sheet into two sheets.

8. The disposable pillow of claim 1 wherein the check valve has a width of at least 8.9 cm.

9. The disposable pillow of claim 8 wherein the check valve has a length of at least 11.4 cm, and said top opening extends from the marginal edge seal where the check valve is located.

10. A disposable pillow comprising:

two sheets stacked and registered to form two side walls;

at least one marginal edge formed by sealing the perimeter of the two sheets to create a seal;

a flat check valve located between the two side walls in the at least one marginal edge, so as to locally break the marginal edge seal where the check valve is located;

wherein the check valve comprises:

a first side portion:

a second side portion registered with the first side portion and sealed along two opposite edges to form a first side seal and a second side seal, and creating a top opening and a bottom opening;

a first valve seal extending from the first side seal and terminating at the bottom opening; and a second valve seal extending from the second side seal and terminating at the bottom opening;

wherein the first valve seal and second valve seal converge at the bottom opening.

11. The disposable pillow of claim 10 further including a tube removably attached to an exterior surface of one of the two side walls.

12. The disposable pillow of claim 10 wherein at least one of the two sheets is comprised of a multiple ply material having an outermost ply of an absorbent material.

13. The disposable pillow of claim 12 wherein the absorbent material is a nonwoven fabric.

14. The disposable pillow of claim 12 wherein the absorbent material is paper.

15. The disposable pillow of claim 10 further including an outer covering coupled to the two side walls.

16. A method of manufacturing an inflatable article comprising the steps of:

stacking and registering two sheets of flexible material together;

placing a flexible flat check valve between the two sheets of material, the check valve having a first side portion;

a second side portion registered with the first side portion and sealed along two opposite edges to form a first side seal and a second side seal, and creating a top opening and a bottom opening;

a first valve seal extending from the first side seal and terminating at the bottom opening; and a second valve seal extending from the second side seal and terminating at the bottom opening;

wherein the first valve seal and second valve seal converse at the bottom opening;

positioning the check valve so that the top opening is coincidental with a first edge of the two sheets; and sealing the two sheets of material together to form a seal around the perimeter of the two sheets of material, without sealing closed the top opening of the check valve.

17. The method of claim 16 wherein the check valve is substantially rectangular in shape, and has a side located between the exterior opening and the interior opening that is coincidental with the seal.

18. The method of claim 16 further including the step of attaching a tube for inflating the article to an exterior surface of one of the two sheets of material.

19. The method of claim 16 further including the step of attaching an outer covering to at least one of the two sheets of material.

20. A check valve for use in an inflatable article, the check valve comprising:

a first side portion;

a second side portion registered with the first side portion and sealed along two opposite edges to form a first side seal and a second side seal, and creating a top opening and a bottom opening;

a first valve seal extending from the first side seal and terminating at the bottom opening;

a second valve seal extending from the second side seal and terminating at the bottom opening; and wherein the first valve seal and second valve seal converge at the bottom opening.

21. The cheek valve of claim 20 wherein the first valve seal extends from the first side seal at the top opening, and the a second valve seal extends from the second side seal at the top opening.

22. The check valve of claim 21 wherein the first valve seal and the second valve seal are symmetrically positioned on the check valve.

23. The check valve of claim 20 wherein the length of the check valve measured at the first side seal and the second side seal is at least 11.4 cm.

24. The check valve of claim 20 wherein the width of the check valve measured between the first side seal and the second side seal is at least 8.9 cm.

25. The check valve of claim 24 wherein the first valve seal and the second valve seal serves to effectively narrow the bottom opening to a width of 2.54 cm.

* * * * *